US005279218A

United States Patent [19]

Oshio et al.

[11] Patent Number: 5,279,218

[45] Date of Patent: Jan. 18, 1994

[54] MIMEOGRAPHIC PRINTING MACHINE

[75] Inventors: Susumu Oshio; Kouichiro Iida, both of Ushiku, Japan

[73] Assignee: Riso Kagaku Corporation, Tokyo, Japan

[21] Appl. No.: 61,101

[22] Filed: May 14, 1993

[30] Foreign Application Priority Data

May 19, 1992 [JP] Japan ..... 4-126263
May 12, 1993 [JP] Japan ..... 5-110648

[51] Int. Cl.[5] ..... B41F 5/02

[52] U.S. Cl. ..... 101/2; 270/58; 271/288; 271/296; 101/90

[58] Field of Search ..... 101/2, 90; 270/58; 271/287, 288, 292, 296

[56] References Cited

U.S. PATENT DOCUMENTS 3,804,005 4/1974 Burger et al. ..... 101/2
3,905,594 9/1975 Davis ..... 271/296
4,361,320 11/1982 Kikuchi ..... 271/288
4,387,639 6/1983 Brown et al. ..... 101/2
4,445,680 5/1984 Kikuchi et al. ..... 271/296
4,527,468 7/1985 Plotroski ..... 101/2
4,561,352 12/1985 Svyatsky ..... 101/2
4,831,553 5/1989 Yoshino ..... 101/2
4,881,730 11/1989 Kaneko ..... 271/296
4,900,009 2/1990 Kitahara et al. ..... 271/288
5,141,222 8/1992 Sawada et al. ..... 271/296

*Primary Examiner*—Eugene H. Eickholt
*Attorney, Agent, or Firm*—Kanesaka and Takeuchi

[57] ABSTRACT

A mimeographic printing machine comprising: mimeographic printing means for printing an image of an original document on successive sheets one at a time and for discharging the printed sheets; a sorter having a plurality of bins for receiving the printed sheets discharged from the mimeographic printing means; mode setting means for setting up the sorter for a specified mode such that a number of the printed sheets, which are printed for the same original document and exceed the number of the bins of the sorter, will be received on the bins in a specified order; and control means for detecting that the specified mode is set up by the mode setting means and for controlling the mimeographic printing means and the sorter in such a manner that the printed sheets discharged from the mimeographic printing means will be received orderly one after another in the bins, from the first bin to the last bin, and then the following printed sheets discharged from the mimeographic printing means will be received orderly one after another in the bins from the first bin.

6 Claims, 7 Drawing Sheets

MIMEOGRAPHIC PRINTING MACHINE

BACKGROUND OF THE INVENTION

1. Field of the Invention

This invention relates to a mimeographic printing machine which has a printing drum to be driven to rotate with a mimeographic stencil wound on its outer circumferential surface and in which ink supplied from the inside the master drum is transferred to successive print sheets one at a time through pores of the mimeographic stencil.

2. Description of the Related Art

Many of modern printers or the like are equipped with a sorter for automatically sorting printed sheets which have been discharged from the printer, individually into a plurality of bins (receptacles). At the start of printing, the user may select any of the following facilities:

(1) The group sort mode, in which a number of printed sheets for each of pages of an original document will be received collectively on a respective bin.

(2) The sort mode, in which a number of printed sheets for each of pages of an original document will be received consecutively on the respective bins in the order of paging of an original document; that is, a set of printed sheets for all of the pages of the original document will be received on every bin in the order of paging of the original document.

(3) The non-sort mode, in which all of printed sheets will be received directly on a discharge tray, without using the sorter. This mode is used for a trial print or mass print.

However, in the mimeographic printing machine, ink is forced through fine pores of the mimeographic stencil from one side to the other of the stencil by the pressure means, which is situated outside the master drum, to attached onto a sheet during the printing. If the non-sort mode of (3) above is selected, before the ink attached to the preceding printed sheet has not yet been dried up, the succeeding print sheet is placed over this preceding one so that the ink on the previous printed sheet would be transferred to the back surface of the next sheet, which is so called a back transfer phenomenon.

For preventing such back transfer phenomenon, it has been a common practice to insert unprinted sheets one by one between successive printed sheets. But this inserting have to be done in conformity to the sheet discharge speed of the mimeographic printing machine, and after the printing, these inserted unprinted sheets have to be removed, which is laborious and time-consuming.

In another conventional attempt, a drier was used inside or outside the mimeographic printing machine. The whole system would be bulk and would be difficult to secure safety as the drier was in the form of a hot air blower or heat rollers, thus resulting in an increased cost of production.

SUMMARY OF THE INVENTION

With the foregoing problems in view, it is therefore an object of this invention to provide a mimeographic printing machine which adequate time is secured in sorting printed sheets to dry ink so as not to be transferred to the back surface of the next sheet.

According to a first aspect of the invention, there is provided a mimeographic printing machine comprising:

(a) mimeographic printing means for printing an image of an original document on successive sheets one at a time and for discharging the printed sheets;

(b) a sorter having a plurality of bins for receiving the printed sheets discharged from the mimeographic printing means;

(c) mode setting means for setting up the sorter for a specified mode such that a number of the printed sheets, which are printed for the same original document and exceed the number of the bins of the sorter, will be received on the bins in a specified order; and (d) control means for detecting that the specified mode is set up by the mode setting means and for controlling the mimeographic printing means and the sorter in such a manner that the printed sheets discharged from the mimeographic printing means will be received orderly one after another in the bins, from the first bin to the last bin, and then the following printed sheets discharged from the mimeographic printing means will be received orderly one after another in the bins from the first bin.

According to a second aspect of the invention, there is provided a mimeographic printing machine comprising:

(a) mimeographic printing means for printing an image of an original document on successive sheets one at a time and discharging the printed sheets;

(b) a sorter having a plurality of bins for receiving the printed sheets discharged from the mimeographic printing means;

(c) mode setting means for setting up the sorter for a specified mode such that a number of the printed sheets, which are printed for the same original and exceed the number of the bins of the sorter, will be received in the bins from the first bin to the last bin, or from the last bin to the first bin, and that the mimeographic printing means will then be temporarily deactivated and that the following printed sheets will be received in the individual bins as those discharged from the mimeographic printing means after the lapse of a predetermined time from the temporary deactivation of the mimeographic printing means; and (d) control means for detecting that the specified mode is set up by the mode setting means and for controlling the mimeographic printing means and the sorter in such a manner that the printed sheets discharged from the mimeographic printing means will be received orderly one after another in the bins, from the first bin to the last bin, and that the mimeographic printing means will then be temporarily deactivated and that the following printed sheets will be received orderly one after another in the bins, from the first bin or from the last bin, after the lapse of a predetermined time from the temporary deactivation of the mimeographic printing means.

In operation, when the printed sheets are successively discharged from the printing section, the bins in the sorter are moved step by step every time the individual printed sheet is supplied, so that the bins from the first bin, i.e. the uppermost bin, receive the printed sheets orderly one after another. When the printed sheets have thus been received into all of the bins, the bins will be moved again in such a manner that the following printed sheet will be received into the first bin.

It is therefore possible to secure adequate time to dry up ink by the time the next printed sheet is placed over the previous printed sheets, so that the back transfer phenomenon can be prevented even if the printed sheets are received one over another in each bin.

DERTAILED DESCRIPTION

Figure 1:
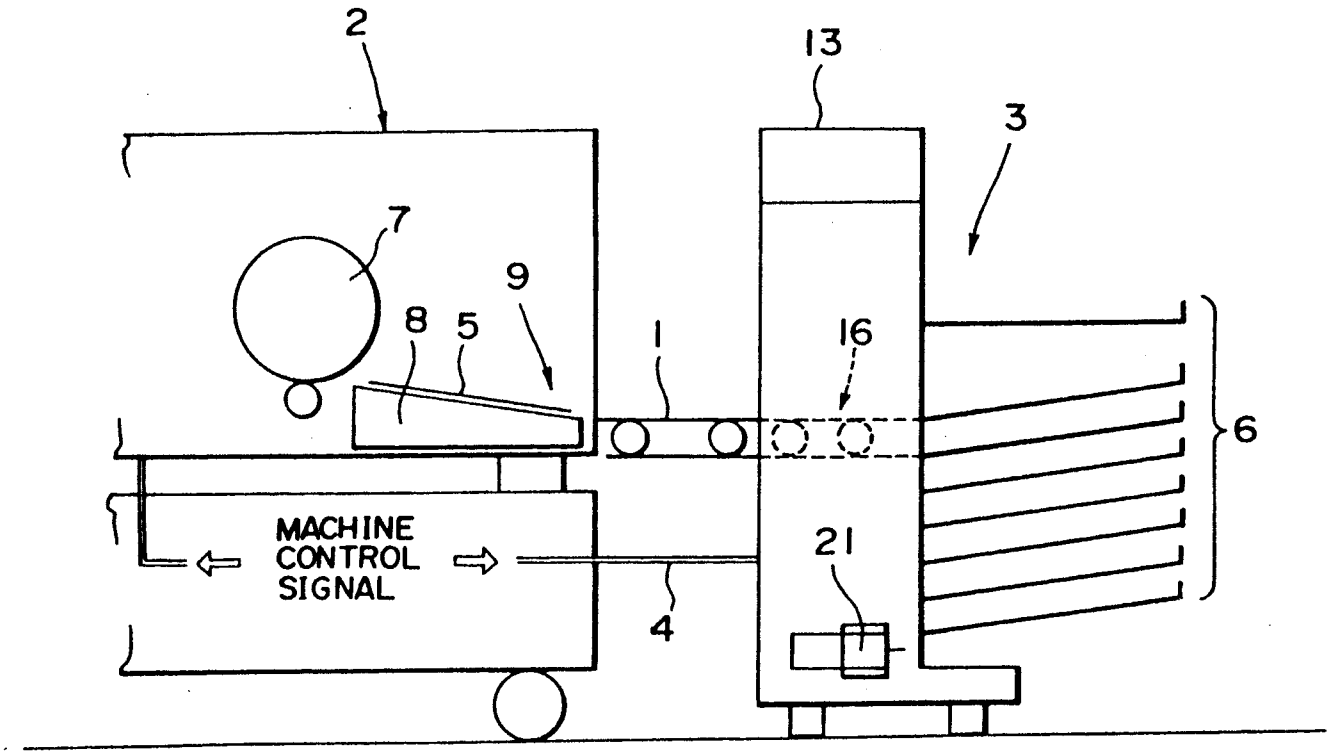
FIG. 1 is a diagram showing the whole structure of a mimeographic printing machine of this invention.
Figure 2:
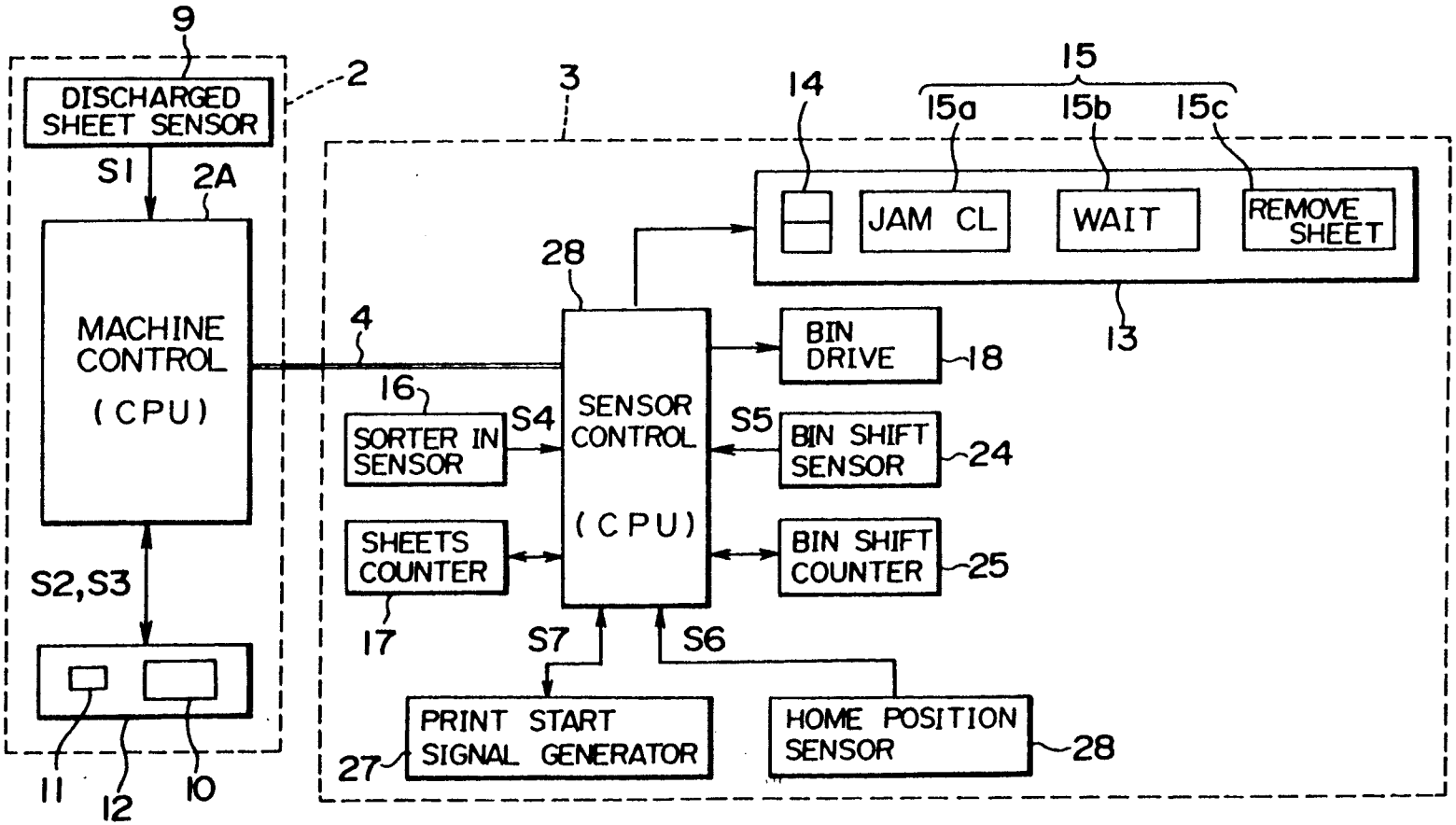
FIG. 2 is a block diagram of the machine.

FIG. 1 is a diagram showing the whole structure of a mimeographic printing machine embodying this invention, and FIG. 2 is a block diagram of the machine.

The mimeographic printing machine of this embodiment comprises a printing section 2 and a sorter section 3 connected with each other via a sheet conveyer belt 1. The printing section 2 and the sorter section 3 are electrically connected by a communication cable 4. In the sorter section 3, printed sheets 5 discharged from the printing section 2 will be received in bins 6 at any of the "sort", "non-sort" and "sequence" modes.

The printing section 2 has a printing drum 7 as a printing drum to be rotated with a mimeographic stencil wound on its outer circumferential surface. During the printing, ink supplied from inside of the printing drum 7 is transferred to a print sheet, then the printed sheet 5 is discharged via a sheet discharge unit 8, and then the printed sheet 5 discharged from the printing section 2 is conveyed to the sorter section 3 via a conveyer belt 1. The controlling of this printing is performed based on a control signal from a printing control means 2A. At the discharge port of the printing section 2, a discharge sensor 9 is situated for detecting the printed sheet 5 to be discharged and for outputting a discharge signal S1 to the printing control means 2A. The printing section 2 is also equipped with an operating panel 12 which has instruction keys 10 such as figure keys for outputting to the printing control means 2A instruction signals S2 for instructing the number of sets and the starting and stopping of printing, and a mode setting means 11 for instructing the sorter section 3, which is connected with the printing section 2, to sort the printed sheets 5.

Figure 3:
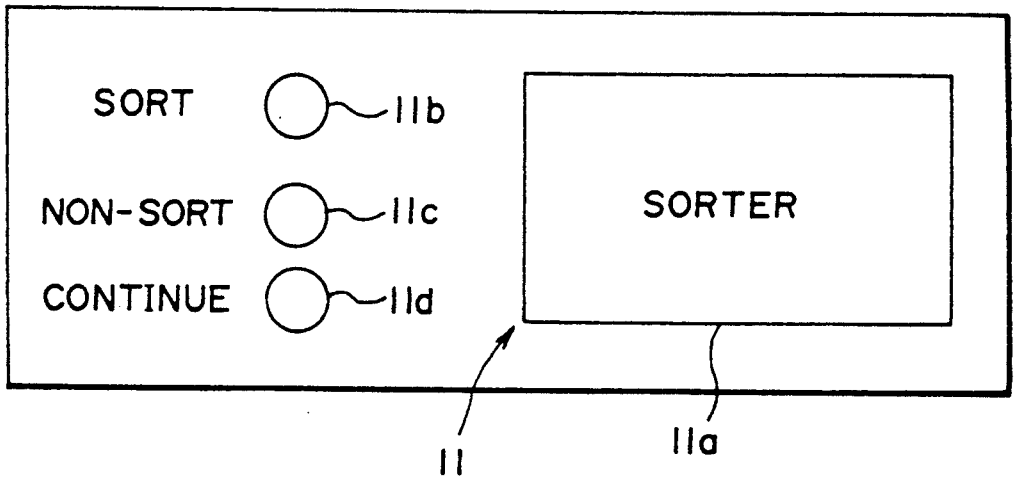
FIG. 3 is a diagram showing mode setting keys of a printing section in the machine.

Upon every depression of a rectangular mode change-over key 11*a* as shown on the righthand side in FIG. 3, the lighting of three mode displays (e.g., LEDs) 11*b*, 11*c*, 11*d* as shown on the lefthand side in FIG. 3 and corresponding to the "sort", "non-sort" and "sequence" modes, respectively, will be switched orderly one to another so that the user can observe the current status of the sorting.

More specifically, if the "sort" mode display 11*b* is lighted on, it indicates that the sorter section 3 is set up for the sort mode in which plural pages of an original document are to be printed on the same number of sheets in the order of pages of the original document and then the printed sheets are to be sorted orderly into bins 6A–6G. If the "non-sort" mode display 11*c* is lighted on, it indicates that the sorter section 3 is set up for the non-sort mode in which all of the printed sheets 5 are to be received on a non-sort bin 6*a*. If the "sequence" mode display is lighted on, it indicates that the sorter section 3 is set up for the sequence mode in which the printed sheets 5 are sorted one after another into the individual bins 6A–6G, from the first to the last, whereupon the sorting of the remaining printed sheet 5 is to be started from the first bin, e.g. the uppermost bin 6A.

Thus any of the "sort", "non-sort" and "sequence" mode keys 11*b*, 11*c*, 11*d* is normally lighted on, with the sorter section 3 connected with the printing section 2, the mode setting means 11 outputs a mode signal S3, which indicates the selected mode, to the sorter section 3 via the communication cable 4.

The sorter section 3 comprises the sort bins 6, an operating panel 13, a sorter-in sensor 16, a sheet counter 17, a bin drive means 18, a bin shift sensor 24, a bin shift counter 25, a home position sensor 26, a print start signal generating means 27, and a sorter control means 28.

The bins 6 are composed of, for example, a single non-sort bin 6*a* and seven sort bins 6A–6G. The printed sheets 5 discharged from the printing section 2 via the sheet conveyer belt 1 can be received on the bins 6 at any mode, of "sort", "non-sort" or "sequence", which is selected by the mode setting means 11 of the printing section 2.

The operating panel 13 includes a display region 14, such as of seven segments, for displaying the number of printed sheets 5, and various function keys 15, such as a jam clear key 15*a*, a WAIT key 15*b* for setting a time t (FIG. 5) during which a print start signal S7 is off except the time the bins are lowered, and a sheet remove key 15*c*.

The sorter-in sensor 16, which is situated in a sheet-supply region of the sorter section 3, detects a printed sheet 5 discharged from the printing section 2 and outputs to the sorter control means 28 a sheet supply signal S4 which is to be on at the leading end of the printed sheet 5 and to be off at the trailing end of the same sheet 5. Based on the sheet supply signals S4, the sheet counter 17 counts the number of printed sheets 5 received from the printing section 2.

The bin drive means 18, which is controlled by a control signal from the sorter control means 28, includes a bin shift cam 19, a worm gear 20, a bin shift motor 21, and a slitted disk 22.

More specifically, the bin shift cam 19 is in engagement with the individual bins 6 via part of a side plate 23. The bin shift cam 19 is connected at one end to the bin shift motor 21 via the worm gear 20 and at the other end to the slitted disk 22. And the bin shift sensor 24 is situated in such a manner as to sandwich the slitted disk 22.

The bin shift sensor 24 detects a slit (not shown) of the slitted disk 22 every time the bin shift cam 19 makes a rotation as driven by the bin shift motor 21, and outputs to the sorter control means 28 a shift signal S5 which is to be on and off.

Based on the shift signals S5 output from the bin shift sensor 24, the bin shift counter 25 counts the number of times the bins 6 are vertically moved.

The home position sensor 26, for detecting that the non-sort bin 6*a* is located at the home position on the extension of the sheet conveyer belt 1, detects a projection (not shown) extending from the lower end of the side plate 23 and outputs to the sorter control means 28 a position signal S6 which is to be on and off. If both the home position sensor 26 and the bin shift sensor 24 are on, the content of the bin shift counter 25 will be reset.

In this machine, the non-sort bins 6a will be returned to their original position, i.e. the home position in the following cases: when the mode is changed; when the power source of the printing section 2 is energized; when every setting is reset at the printing section 2; when the number of printed sheets 5 of one page from the original has become larger than the number of bins 6 in the sort mode; after the printing process of the previous original is finished and before the printing section 2 starts the master making process for the next original; and when the sorter has been kept out of use for a predetermined time.

If the bin shift sensor 24 outputs a shift signal S5 as the sorter section 3 is ready to received the printed sheet, if the home position sensor 26 outputs a position signal S6 as the non-sort bin 6a is located at the home position, and if the sorter-in sensor 16 is off and a cover for the sheet conveyer belt 1 is closed as a cover switch (not shown) on the sheet conveyer belt 1 is on, i.e. there is no jamming in the sorter section 3, the print start signal generating means 27 sends a print start signal S7 to the printing section 2 via the communication cable 4, thus controlling the printing process of the printing section 2 according to the on-off status of this print start signal S7.

The sorter control means 28 outputs control signals to various parts to control the starting and stopping of the sorter section 3, based on signals from the operating panel 13, other signals (i.e., a sheet supply signal S4, a shift signal S5, a position signal S6 and a print start signal S7) from the individual sensors 16, 24, 26 and also based on signals (i.e., a sheet discharge signal S1 by the sheet discharge sensor 9, and an instruction signal S2 and a mode signal S3 by the operating panel 12) sent from the printing section 2 via the communication cable 4.

Specifically, the sorter control means 28 drives the bin shift motor 21 at the falling of the sheet supply signal S4 of the sorter-in sensor 16 and moves the bins 6 vertically step by step every time a printed sheet 5 has been received on the individual bin 6. At that time, the bin shift counter 25 counts the number of times the bins 6 are moved vertically every time the bin shift sensor 24 detects the slit of the slitted disk 22. In the case where the counted value coincides the number of bins 6, if the mode is "sort", the sorter control means 28 will drive the bin shift motor 21 to rotate reversely to move the bins 6 vertically until the non-sort bin 6a comes to the home position. If the mode is "sequence", the sorter control means 28 drives the bin shift motor 21 to rotate reversely to move the bins 6 until the uppermost bin 6A comes to the home position.

The operation of the machine will now be described.

Firstly, the operation of the "sort" mode will be described.

Figure 4:
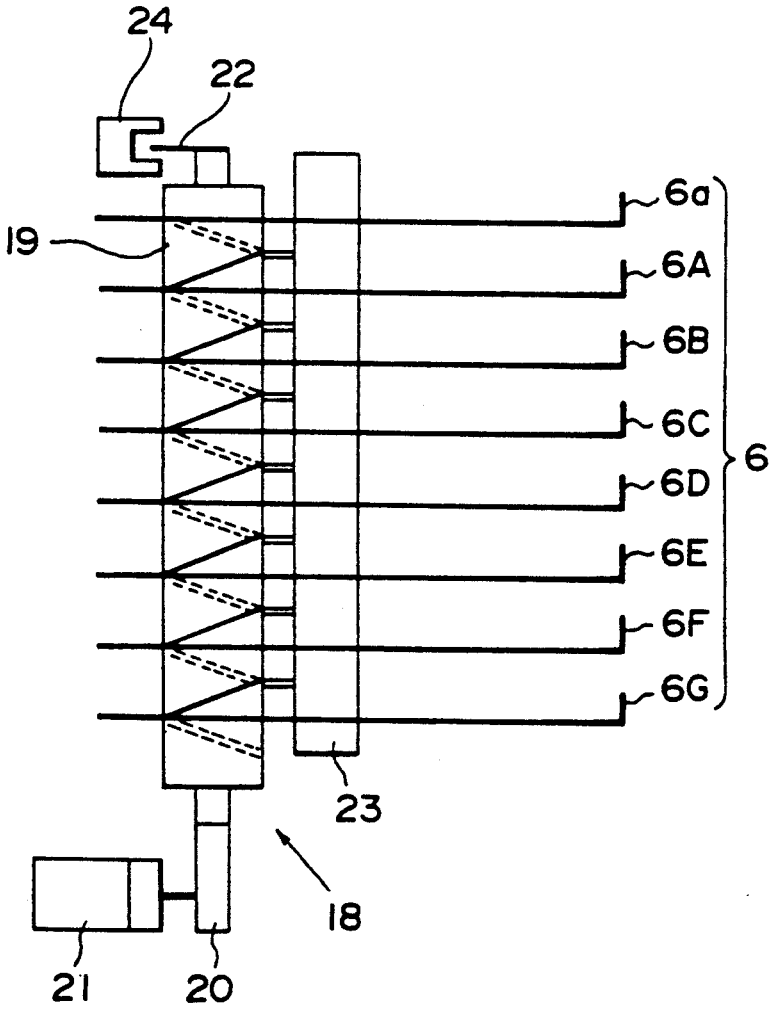
FIG. 4 is a diagram showing a bin drive means of a sorter section of the machine.
Figure 6:
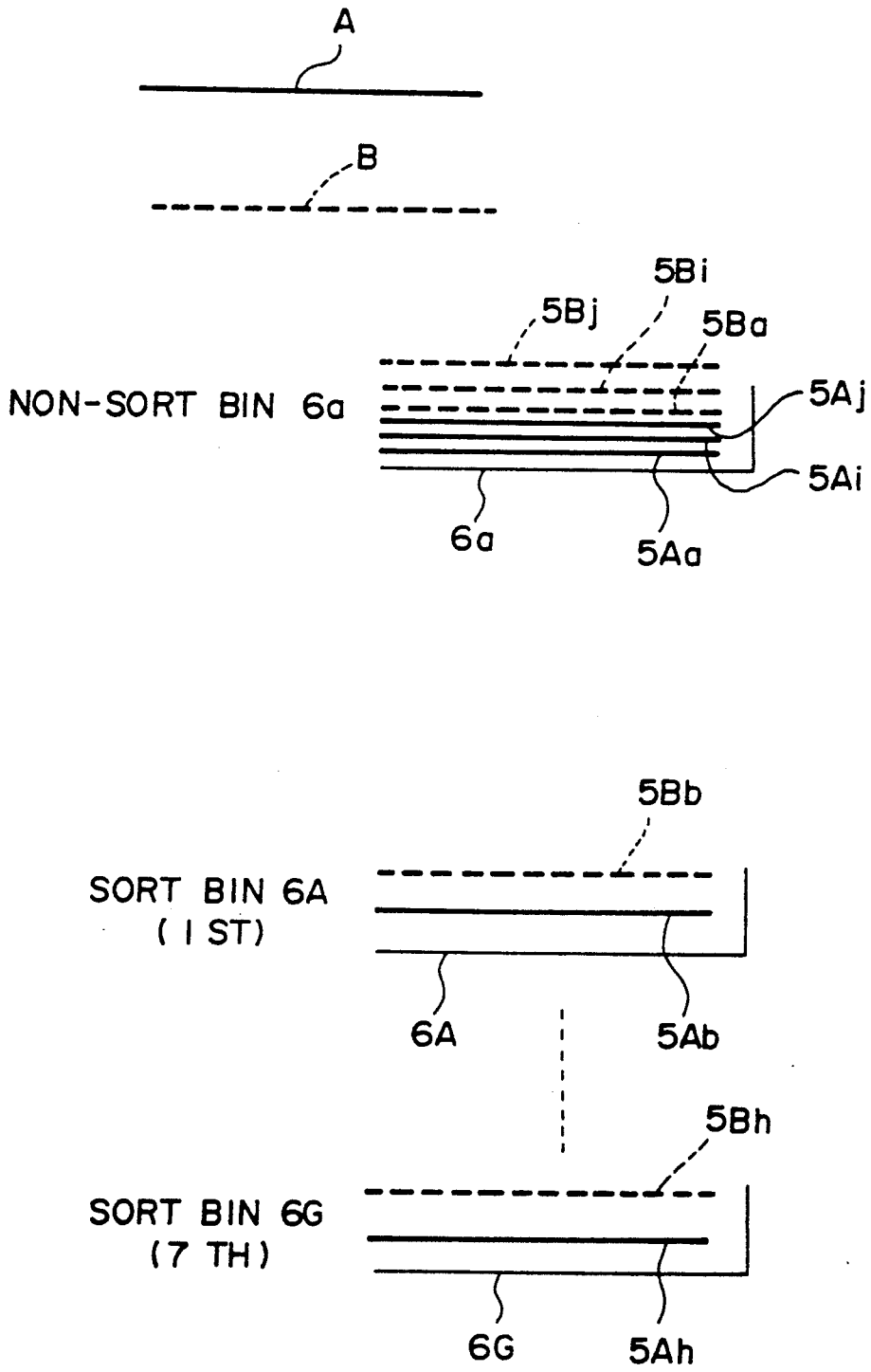
FIG. 6 illustrates the "sort" mode of the machine.

In the illustrated example, two pages A (indicated by solid lines) and B (indicated by broken lines) of an original in FIG. 6 are printed each on nine sheets, whereupon these printed sheets are sorted in the sorter section 3 having a single non-sort bin 6a and seven bins 6A–6G of FIGS. 1 and 4.

The user sets, on the operating panel 12 of the printing section 2, the number of sheets to be printed and the print speed and then depresses a non-illustrated print start key. The printing section 2 starts the printing operation after a succession of previous processes, i.e. removing the previous master, reading the original, making a new master and mounting the new master. At that time, the printing section 2 checks the status of the sorter section 3 via the communication cable 4 electrically connecting the printing section 2 with the sorter section 3.

If the sorter section 3 is ready to operate, namely, the bin shift sensor 24 is on as the sort bin 6 is ready to receive the printed sheets, and also if the sorter-in sensor 16 is off and a cover for the sheet conveyer belt 1 is closed as a non-illustrated cover switch is on, i.e. there is no jamming, the print start signal generating means 27 generates a print start signal S7 and sends it to the printing section 2 via the communication cable 4.

The printing section 2 will start the printing upon receipt of the print start signal S7. Then the first printed sheet 5Aa for the first page A of the original will be received on the non-sort bin 6a; at this time, the printed sheet 5Aa will not be counted by the sheet counter 17 as it is a trial print. Since then the bin shift motor 21 will be driven to rotate forwardly at the timing of the falling of a sheet supply signal S4 output every time the sorter-in sensor 16 detects a printed sheet 5A, so that the printed sheets 5A will be received orderly onto the bins 6, from the first bin 6A to the seventh bin 6G as the bins are moved step by step. During that time, the sheet counter 17 counts up the number of the printed sheets 5A in terms of the sheet supply signals S4 from the sorter-in sensor 16, and the bin shift counter 25 counts the number of times the bins 6 are vertically moved, in terms of the shift signals S5 from the bin shift sensor 24. When the printed sheets 5A have thus been received on the bins 6 up to the seventh bin 6G, all of the bins 6 will be lowered until the non-sort bin 6a is returned to the home position, whereupon the remaining two printed sheets 5Ai and 5Aj will be received onto the non-sort bin 6a.

While the printed sheets 5A are received onto the bins 6, if jamming happens to occur, for example, if the sorter section 3 stops operating because of jamming when the sorter-in sensor 16 detects the third printed sheet, it will be judged that only first two printed sheets have been received in the bins 6, and after jamming will be settled by disposing the jammed sheet, the user will cancel the display of jamming manually (or the display of jamming will be canceled automatically), thus causing the sorter section 3 to be ready to operate. Subsequently, when the print start key of the printing section 2 is depressed, the following printed sheets 5A will be conveyed to the sorter section 3 to restart the sorting from the third bin.

Next, when the sheet discharge sensor 9 in the printing section 2 has detected the trailing end of the ninth printed sheet 5Aj to output a sheet discharge signal S1 to the sorter section 3 via the communication cable 4, the sorter section 3 will cause the print start signal S7 to be off at the rising of the sheet discharge signal S1.

Likewise, also the first printed sheet 5Ba for the second page B of the original will be received on the non-sort bin 6a as it is a trial print. Since then the following printed sheets 5B will be received on the bins 6 from the first bin 6A to the seventh bin 6G, whereupon the remaining two printed sheets 5Bi and 5Bj will be received on the non-sort bin 6a.

In this case, the receiving of the printed sheets 5Ai, 5aj, 5Bi and 5Bj onto the non-sort bin 6a has not been done at the "sort" mode.

Now, if the set-up number of sheets to be printed exceeds the number of bins of the sorter section 3 when the user selects the "sort" mode on the operating panel 12 of the printing section 2, a warning that it is unable to print may be issued such as by alarming, without causing the sorter section 3 not to generate a print start signal S7.

Figure 7:
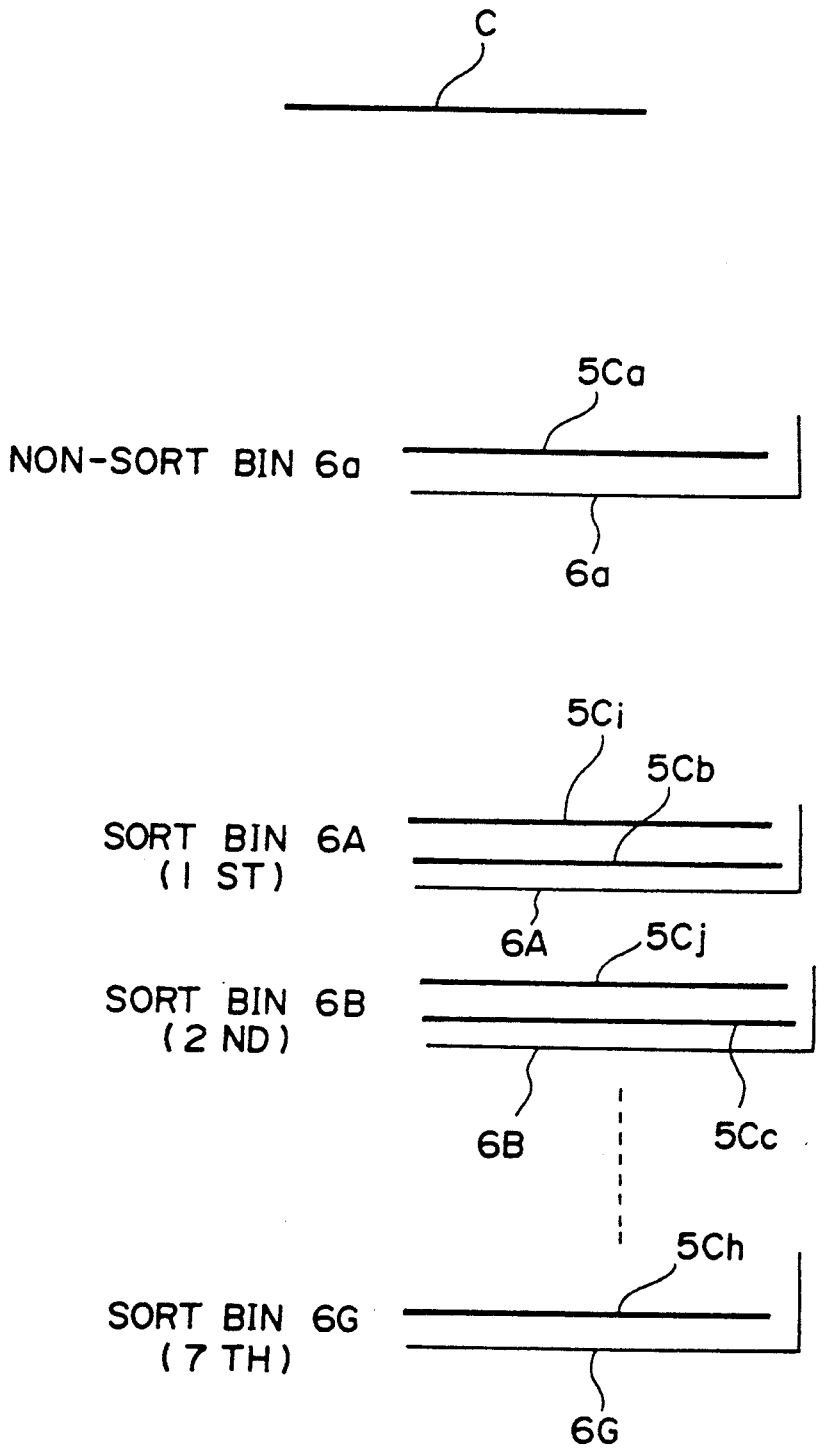
FIG. 7 illustrates the "sequence" mode of the machine.

The manner in which a single page original C is printed on nine sheets at the "sequence" mode will now be described with reference to FIG. 7.

Any repetition of the foregoing description of the "sort" mode is omitted here for clarity.

The user sets the "sequence" mode on the operating panel 12 of the printing section 2 and then the number of sheets to be printed, the print speed, etc., and then depresses the print start key. As a result, the printing section 2, which is ready for printing, will start the printing upon receipt of a print start signal S7 from the sorter section 3 via the communication cable 4.

Likewise in the case of the "sort" mode, the first printed sheet 5Ca will be received on the non-sort bin 6a as it is a trial print. Since then the following printed sheets 5C will be received on the bins 6 orderly from the first bin 6A to the seventh bin 6G. Upon completion of the receiving of the printed sheets up to the seventh bin 6G, the bin shift motor 21 will be driven, at the falling of the shift signal S5 from the bin shift sensor 24, to reversely rotate to move the bins 6 downward until the first bin 6A is returned to the home position on the extension of the sheet conveyer belt 1.

Meanwhile, if the sheet discharge sensor 9 of the printing section 2 has detected the trailing end of the seventh printed sheet 5Ch, the discharge signal S1 will be output to the sorter section 3 and the sorter section 3 will cause the print start signal S7 to be off at the rising of the sheet discharge signal S1 upon receipt of the discharge signal S1 of the eighth printed sheet 5Ci via the communication cable 4.

When the bins 6 are lowered to and stop at a predetermined position, the print start signal S7 will be on again. Subsequently, the bin shift motor 21 will be driven to rotate forwardly at the timing of the falling of the sheet supply signal S4 output every time the sorter-in sensor 16 detects a printed sheet 5C, so that the eighth printed sheet 5Ci from the printing section 2 will be received on the first bin 6A, whereupon the ninth printed sheet 5Ci will be received on the second bin 6B (FIG. 7).

In the case of the "sequence" mode, the first printed sheet 5 is received on the non-sort bin 6a as it is a trial print, and then the following printed sheets are received orderly on the bins 6 from the first bin 6A to the last bin 6G. In the case where the number of printed sheets 5 for the same original exceeds the number of bins, since the receiving of the printed sheets on the bins will restart from the first bin 6A upon completion of the receiving of printed sheets on all the bins 6, it will take adequately long time for the next printed sheet 5 to be placed over the previous printed sheet 5, during which time ink on the previous printed sheet 5 can be dried so as not to transfer to the back surface of the next printed sheet.

Figure 5:
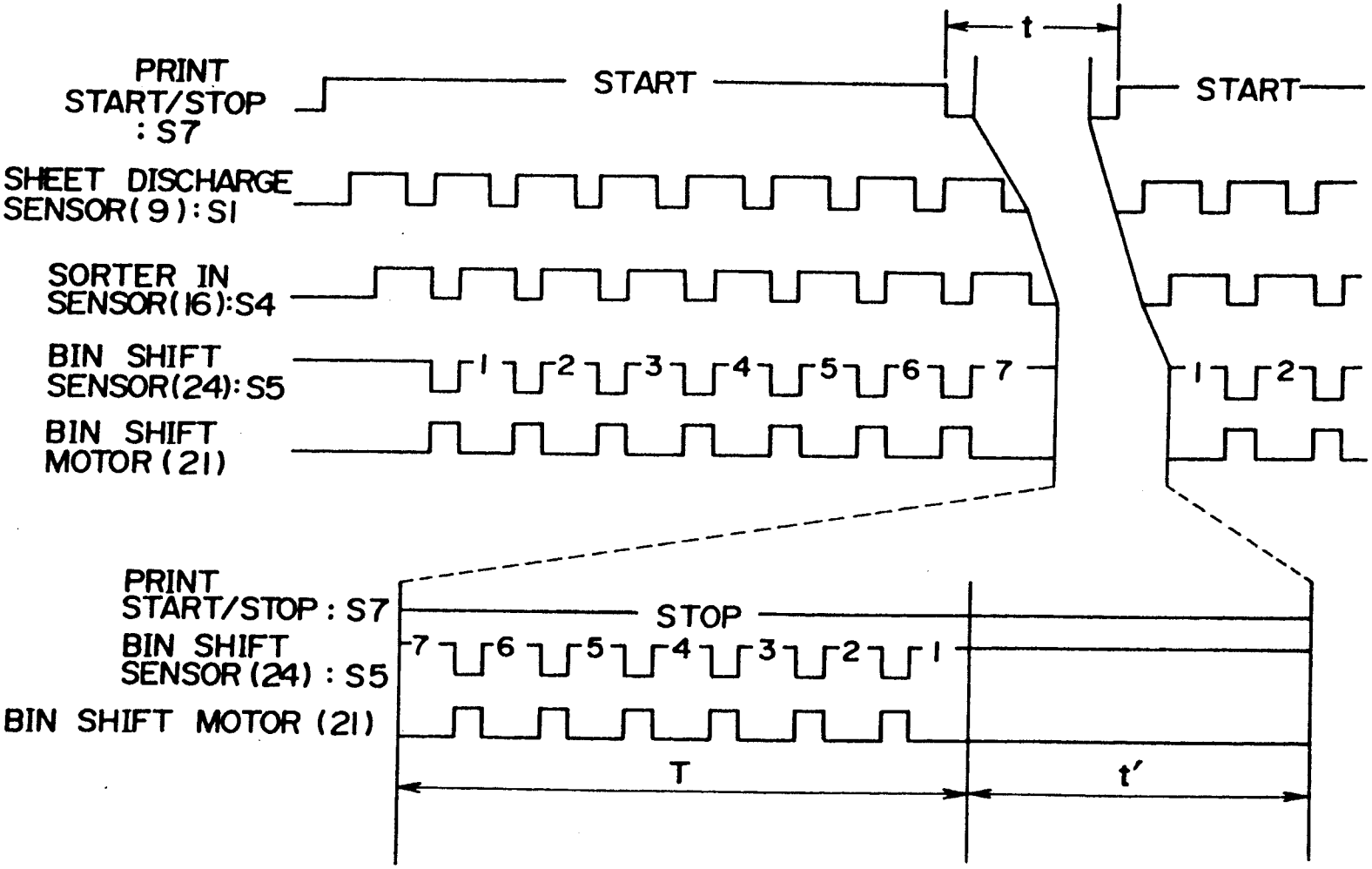
FIG. 5 is a timing diagram showing the manner in which printed sheets are received in bins in the machine.

If a time t (time T, during which the bins 6 are lowered, plus t'), during the print start signal S7 from the sorter section 3 is to be off as shown in FIG. 5, is set by the WAIT key 15b on the operating panel 13 of the sorter section 3 of FIG. 2, it is possible to obtain uniform and dirty-free prints, irrespective of the quality of the print sheets 5 and the kind of ink as well as the circumferential environment such as temperature and moisture.

The time t may be started from the time when the last bin (the seventh bin 6G in this embodiment) is counted by the bin shift sensor 24. Namely, the time t, during which the print start signal S7 is off, may be only the time period ($t>T$) of from when the receiving of all the printed sheets 5 onto the bins 6 has been completed until the bins 6 are lowered and then returned to the sheet receiving position; if $t=T$ ($t'=0$), it is in normal operation.

By adjusting the time t by this WAIT key 15b, it is possible to make the rate of rotation of the bin shift motor 21 to be lower than normal.

The WAIT key 15b may be situated in the printing section 2 so that time setting and other setting can be made using the WAIT key 15b and the figure keys in combination.

Assuming that the time t is set to be relatively long, upon completion of the receiving of all the bins 6, the eighth printed sheet 5, for example, can be received on the last bin 6G without causing the bins 6 to return to the home position, and since then the following printed sheets 5 can be orderly received on the bins 6 as lowered step by step.

The mode setting means 11 situated in the printing section 2 for setting the mode of "sort", "non-sort" or "sequence" may be situated alternatively in the sorter section 3.

The following arrangement for temporarily stopping the printing operation for a predetermined time t can be considered.

The arrangement includes a counting means for outputting a signal, when the number of printed sheets received by the sorter coincides with the total number of bins, based on the count results of the sheet counter 17 and the bin shift counter 25. The arrangement also includes a print temporarily stop signal generating means for generating, upon receipt of the signal from the counting means, a signal which will temporarily stop the printing operation of the mimeographic printing means. This print temporary stop signal can be regarded as an inverted signal of the print start signal. Upon receipt of the print temporary stop signal, a timer will measure a preset time. When the timer has measured the preset time, the print temporary stop signal will be off to restart the printing. This timer may be a timer in the sorter control means 28, or may be a separate timer outside the sorter control means 28. The predetermined time to be preset in the timer may be optionally preset such as by the WAIT key 15b of the operating panel 13.

In this embodiment, the printed sheets 5 discharged from the discharge port of the printing section 2 is conveyed to the sort section 3 where they are sorted into the individual bins 6 confronting the discharge port, in the order of paging of the original, as all the bins 6 are moved one by one (i.e., in parallel to one another). This invention may also be applied to the following alternative sorter section 3 in which the bins are fixed or the bins are opened and moved one by one, causing the same results.

(1) The sorter in which the bins are fixed:

While the printed or copied sheets discharged from the discharge port of a printer or copier are conveyed to the sorter by a belt conveyer in the sorter, the conveying direction is changed by a deflector to direct the conveyance of the sheet to a designated bin. The sheets will be received on the designated bins at the timing of actuation of the deflector.

(2) The sorter in which bins open and move one by one:

While the printed or copied sheets discharged from the discharge port of a printer or copier are conveyed to the sorter, the bins arranged one over another in a fan form are selectively opened and moved one by one at the portion confronting the discharge port of the printer or copier.

As described above, according to the mimeographic printing machine of this invention, partly since the bins will be moved upwardly or downwardly one by one every time a printed sheet is received on the individual bin, and partly since when each of all the bins have received a printed sheet, the following printed sheets will be received again on the bins orderly from the first bin, it is possible to prevent ink on the preceding printed sheet from being transferred to the back surface of the next printed sheet.

What is claim is:

1. A mimeographic printing machine comprising:

(a) mimeographic printing means for printing an image of an original document on successive sheets one at a time and for discharging the printed sheets;

(b) a sorter having a plurality of bins for receiving the printed sheets discharged from said mimeographic printing means;

(c) mode setting means for setting up said sorter for a specified mode such that a number of the printed sheets, which are printed for the same original document and exceed the number of said bins of said sorter, will be received on said bins in a specified order; and (d) control means for detecting that the specified mode is set up by said mode setting means and for controlling said mimeographic printing means and said sorter in such a manner that the printed sheets discharged from said mimeographic printing means will be received orderly one after another in said bins, from the first bin to the last bin, and then the following printed sheets discharged from said mimeographic printing means will be received orderly one after another in said bins from the first bin.

2. A mimeographic printing machine comprising:

(a) mimeographic printing means for printing an image of an original document on successive sheets one at a time and discharging the printed sheets;

(b) a sorter having a plurality of bins for receiving the printed sheets discharged from said mimeographic printing means;

(c) mode setting means for setting up said sorter for a specified mode such that a number of the printed sheets, which are printed for the same original and exceed the number of said bins of said sorter, will be received in said bins from the first bin to the last bin, or from the last bin to the first bin, and that said mimeographic printing means will then be temporarily deactivated and that the following printed sheets will be received in the individual bins as those discharged from said mimeographic printing means after the lapse of a predetermined time from the temporary deactivation of said mimeographic printing means; and (d) control means for detecting that the specified mode is set up by said mode setting means and for controlling said mimeographic printing means and said sorter in such a manner that the printed sheets discharged from said mimeographic printing means will be received orderly one after another in said bins, from the first bin to the last bin, and that said mimeographic printing means will then be temporarily deactivated and that the following printed sheets will be received orderly one after another in said bins, from the first bin or from the last bin, after the lapse of a predetermined time from the temporary deactivation of said mimeographic printing means.

3. A mimeographic printing machine according to claim 2, wherein said control means includes:

(a) counting means for counting the number of the printed sheets discharged from said mimeographic printing means and/or the number of the printed sheets received in said sorter and for outputting a signal when the counted number is equal to the total number of said bins;

(b) temporary-stop-printing signal generating means for generating, upon receipt of the signal output from said counting means, a signal to temporarily deactivate said mimeographic printing means; and (c) time-measuring means for measuring a preset time upon receipt of the signal output from said temporary-stop-printing signal generating means.

4. A mimeographic printing machine according to claim 2, wherein said control means includes:

(a) detecting means for outputting a signal when a specified bin of said sorter arrives at a predetermined position;

(b) temporary-stop-printing signal generating means for generating, upon receipt of the signal output from said detecting means, a signal to temporarily deactivate said mimeographic printing means; and (c) time-measuring means for measuring a preset time upon receipt of the signal output from said temporary-stop-printing signal generating means.

5. A mimeographic printing machine according to claim 3, further comprising temporary-stop-printing time setting means for optionally setting a time to be measured by said time-measuring means.

6. A mimeographic printing machine according to claim 1, wherein said bins of said sorter are arranged horizontally, said sorter further including drive means for driving said bins horizontally for said bins to receive the printed sheet discharged from said mimeographic printing means.

* * * * *